US010753046B2

(12) United States Patent
Zawadzki et al.

(10) Patent No.: US 10,753,046 B2
(45) Date of Patent: Aug. 25, 2020

(54) SOFT, STRONG AND BULKY TISSUE

(71) Applicant: Kimberly-Clark Worldwide, Inc., Neenah, WI (US)

(72) Inventors: Michael Andrew Zawadzki, Appleton, WI (US); Stephen Michael Lindsay, Appleton, WI (US); Christopher Lee Satori, Hortonville, WI (US); Mike Thomas Goulet, Neenah, WI (US); Cathleen Mae Uttecht, Menasha, WI (US); Donald Eugene Waldroup, Roswell, GA (US); Kenneth John Zwick, Neenah, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/452,184

(22) Filed: Jun. 25, 2019

(65) Prior Publication Data

US 2019/0309482 A1 Oct. 10, 2019

Related U.S. Application Data

(62) Division of application No. 15/552,851, filed as application No. PCT/US2015/018009 on Feb. 27, 2015, now Pat. No. 10,385,516.

(51) Int. Cl.

| | |
|---|---|
| ***D21H 11/12*** | (2006.01) |
| ***D21H 27/00*** | (2006.01) |
| ***D21H 21/18*** | (2006.01) |
| ***D21H 25/00*** | (2006.01) |
| ***D21H 27/30*** | (2006.01) |
| ***B31F 1/12*** | (2006.01) |
| ***D21F 2/00*** | (2006.01) |
| ***D21H 11/20*** | (2006.01) |
| ***D21H 27/40*** | (2006.01) |

(52) U.S. Cl.

CPC ..... *D21H 27/005* (2013.01); *B31F 1/12* (2013.01); *D21F 2/00* (2013.01); *D21H 11/12* (2013.01); *D21H 11/20* (2013.01); *D21H 21/18* (2013.01); *D21H 25/005* (2013.01); *D21H 27/002* (2013.01); *D21H 27/30* (2013.01); *D21H 27/40* (2013.01)

(58) Field of Classification Search

USPC ..... 162/132

See application file for complete search history.

(56) References Cited

U.S. PATENT DOCUMENTS

| | | | |
|---|---|---|---|
| 3,455,778 | A | 7/1969 | Bernardin |
| 3,994,771 | A | 11/1976 | Morgan et al. |
| 4,166,001 | A | 8/1979 | Dunning et al. |
| 4,225,382 | A | 9/1980 | Kearney et al. |
| 4,300,981 | A | 11/1981 | Carstens |
| 5,164,045 | A | 11/1992 | Awofeso et al. |
| 6,328,850 | B1 | 12/2001 | Phan et al. |
| 6,821,388 | B2 | 11/2004 | Marsh |
| 6,837,972 | B2 | 1/2005 | Marsh |
| 9,410,292 | B2 | 8/2016 | Lindsay et al. |
| 2002/0007169 | A1 | 1/2002 | Graef et al. |
| 2002/0096287 | A1 | 7/2002 | Jewell et al. |
| 2002/0195215 | A1 | 12/2002 | Holz et al. |
| 2003/0111196 | A1 | 6/2003 | Hu |
| 2004/0140076 | A1 | 7/2004 | Hermans et al. |
| 2005/0252626 | A1 | 11/2005 | Chen et al. |
| 2008/0014428 | A1 | 1/2008 | Vinson et al. |
| 2013/0199741 | A1 | 8/2013 | Stage et al. |
| 2014/0096924 | A1 | 4/2014 | Rekoske et al. |
| 2014/0284010 | A1 | 9/2014 | Shannon |

FOREIGN PATENT DOCUMENTS

| | | | |
|---|---|---|---|
| EP | 0404189 | A1 | 12/1990 |
| EP | 0925403 | A1 | 6/1999 |
| JP | 2013217004 | A | 10/2013 |
| WO | 1996006223 | A1 | 2/1996 |
| WO | 2002014606 | A2 | 2/2002 |
| ZA | 9709287 | B | 5/1998 |

*Primary Examiner* — Mark Halpern

(74) *Attorney, Agent, or Firm* — Kimberly-Clark Worldwide, Inc.

(57) ABSTRACT

The disclosure provides tissue webs and products comprising cross-linked cellulosic fibers. In certain embodiments cross-linked cellulosic fibers are selectively disposed in one or more layers of a multi-layered tissue, wherein the tissue layer comprising cross-linked fibers is adjacent to a layer which is substantially free from cross-linked fiber. The cross-linked fibers may include hardwood kraft fibers reacted with a cross-linking agent selected from the group consisting of DMDHU, DMDHEU, DMU, DHEU, DMEU, and DMeDHEU. Tissue products and webs produced in this manner generally have improved sheet bulk, without losses in strength, compared to similar tissue products produced without cross-linked cellulosic fibers. As such the tissue products of the present invention generally have a basis weight from about 10 to about 50 gsm, a sheet bulk greater from about 8.0 to about 12.0 cc/g and geometric mean tensile from about 730 to about 1,500 g/3".

12 Claims, No Drawings

SOFT, STRONG AND BULKY TISSUE

RELATED APPLICATIONS

The present application is a divisional application and claims priority to U.S. patent application Ser. No. 15/552,851, filed on Aug. 23, 2017, which is a national-phase entry, under 35 U.S.C. § 371, of PCT Patent Application No. PCT/US15/18009, filed on Feb. 27, 2015, all of which are incorporated herein by reference.

BACKGROUND

In the manufacture of paper products, such as facial tissue, bath tissue, paper towels, dinner napkins, and the like, a wide variety of product properties are imparted to the final product through the use of chemical additives applied in the wet end of the tissue making process. Three of the most important attributes imparted to tissue through the use additives and processing are bulk, strength and softness. Increasing bulk allows the tissue maker to use less fiber to produce a given volume of tissue while improving the hand feel of the tissue product. Bulk increases however need to be balanced with softness and strength. Increases in bulk may result in less inter-fiber bonding, which may reduce strength to a point where the product fails in-use and is unacceptable to the user. Any increase in strength however, must also be balanced against softness, which is generally inversely related to strength.

Higher bulk can be achieved by embossing, but embossing normally requires a relatively stiff sheet in order for the sheet to retain the embossing pattern. Increasing sheet stiffness negatively impacts softness. Conventional embossing also substantially reduces the strength of the sheet and may lower the strength below acceptable levels in an effort to attain suitable bulk. In terms of manufacturing economy, embossing adds a unit operation and decreases efficiency.

Another means of balancing bulk, softness and strength is to use a chemical debonding agent such as a quaternary ammonium compound containing long chain alkyl groups. The cationic quaternary ammonium entity allows for the material to be retained on the cellulose via ionic bonding to anionic groups on the cellulose fibers. The long chain alkyl groups provide softness to the tissue sheet by disrupting fiber-to-fiber hydrogen bonds in the sheet. The use of such debonding agents is broadly taught in the art. Such disruption of fiber-to-fiber bonds provides a two-fold purpose in increasing the softness of the tissue. First, the reduction in hydrogen bonding produces a reduction in tensile strength thereby reducing the stiffness of the sheet. Secondly, the debonded fibers provide a surface nap to the tissue web enhancing the "fuzziness" of the tissue sheet. This sheet fuzziness may also be created through use of creping as well, where sufficient interfiber bonds are broken at the outer tissue surface to provide a plethora of free fiber ends on the tissue surface. Both debonding and creping increase levels of lint and Slough in the product. Indeed, while softness increases, it is at the expense of an increase in lint and Slough in the tissue relative to an untreated control. It can also be shown that in a blended (non-layered) sheet the level of lint and Slough is inversely proportional to the tensile strength of the sheet. Lint and Slough can generally be defined as the tendency of the fibers in the paper web to be rubbed from the web when handled.

Other attempts to balance bulk, strength and softness have involved reacting wood pulp fibers with cellulose reactive agents, such as triazines, to alter the degree of hydrogen bonding between fibers. While this perhaps helps to give a product improved bulk and an improved surface feel at a given tensile strength, such products generally have poor tensile strength as a result of the reduced fiber-fiber bonding and exhibit higher Slough and lint at a given tensile strength. As such, such products generally are not satisfactory to the user.

Accordingly, there remains a need in the art for balancing bulk, strength and softness in a tissue product. Further, there is a need for a tissue product that balances these properties, while also providing a tissue product having lint and Slough levels that are acceptable to the user.

SUMMARY

It has now been discovered that bulk, softness and strength may all be balanced by manufacturing a creped tissue product using a fiber furnish that has been treated with a cross-linking agent. Creped tissue products comprising cross-linked fibers generally exhibit little or no degradation in tensile strength while also having improved bulk. Further, in certain instances the creped tissue products of the present invention may also be less stiff and have improved softness, compared to creped tissue products produced using conventional fiber furnish, debonding agents, or fibers treated with cellulosic reactive reagent intended to inhibit hydrogen bonding.

Accordingly, in one embodiment the present invention provides a creped tissue product having a GMT from about 730 to 1,500 g/3", a bulk from about 8.0 to 12.0 cc/g and a Stiffness Index from about 10.0 to about 13.0 and a TS7 value less than about 10.0, such as from about 5.0 to about 10.0.

In other embodiments the present invention provides a non-embossed multi-ply creped tissue product having a GMT greater than about 730 g/3", a bulk greater than about 8.0 cc/g and a Stiffness Index from about 10.0 to about 13.0.

In still other embodiments the present invention provides a non-embossed multi-ply creped tissue product having a GMT from about 730 to 1,200 g/3", a bulk from about 8.0 to about 12.0 cc/g and a Slough less than about 10.0 mg.

In another embodiment the present invention provides a tissue product is produced by reacting a hardwood kraft fiber with a cross-linking agent selected from the group consisting of 1,3-dimethyl-4,5-dihydroxy-2-imidazolidinone (DMDHU), 1,3-dihydroxymethyl-4,5-dihydroxy-2-imidazolidinone (DMDHEU), bis[N-hydroxymethyl]urea (DMU), 4,5-dihydroxy-2-imidazolidinone (DHEU), 1,3-dihydroxymethyl-2-imidazolidinone (DMEU) and 4,5-dihydroxy-1,3-dimethyl-2-imidazolidinone (DMeDHEU) to yield a cross-linked hardwood fiber, forming a first fiber slurry comprising the cross-linked hardwood fiber, forming a second fiber slurry comprising northern softwood kraft fibers, depositing the first and second fiber slurries to form a multi-layered tissue web, drying the multi-layered tissue web, creping the multi-layered tissue web, combining two multi-layered tissue webs to form a multi-ply tissue product, wherein the tissue product comprises from about 5 to about 75 percent, by weight of the tissue product, cross-linked hardwood fiber, and the product has a GMT from about 730 to about 1,200 g/3" and a bulk from about 8.0 to about 12.0 cc/g.

In other embodiments cross-linked fibers are selectively incorporated into one or more layers of a multilayered tissue web to increase bulk and reduce stiffness without a significant reduction in tensile strength. Accordingly, in one preferred embodiment the present disclosure provides a multilayered tissue web comprising cross-linked fibers selectively disposed in one or more layers, wherein the tissue layer comprising cross-linked fibers is adjacent to a layer comprising uncross-linked fiber and which is substantially free from uncross-linked fiber. Generally the cross-linked fibers are present in an amount from about 5 to about 75 percent, by weight of the product, more preferably from about 20 to about 70 percent and still more preferably from about 30 to about 60 percent.

In still other embodiments the disclosure provides a tissue product comprising two or more multi-layered tissue webs, the tissue webs comprising a first, second and third layer, where the first and third layers comprise cross-linked hardwood fibers and the second layer comprises uncross-linked conventional softwood fibers, where the tissue product has a bulk from about 8.0 to about 12.0 cc/g, a GMT from about 730 to about 1,200 g/3" and a Slough from about 6.0 to about 10.0 mg. In a particularly preferred embodiment the second layer is substantially free from cross-linked hardwood fibers and the product is not embossed.

Other features and aspects of the present invention are discussed in greater detail below.

Definitions

As used herein, the term "basis weight" generally refers to the bone dry weight per unit area of a tissue and is generally expressed as grams per square meter (gsm). Basis weight is measured using TAPPI test method T-220.

As used herein, the term "Burst Index" refers to the dry burst peak load (typically having units of grams) at a relative geometric mean tensile strength (typically having units of g/3") as defined by the equation:

$$\text{Burst Index} = \frac{\text{Dry Burst Peak Load (g)}}{GMT\ (\text{g}/3'')} \times 10$$

While Burst Index may vary, tissue products prepared according to the present disclosure generally have a Burst Index greater than about 5.0 such as from about 5.0 to about 6.0.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein the terms "cross-linked fiber" refer to any cellulosic fiber material reacted with a crosslinking agent to impart advantageous properties to the fiber such that when it is formed into a web, the bulk of the web is improved.

As used herein, the term "Durability Index" refers to the sum of the Tear Index, the Burst Index, and the TEA Index and is an indication of the durability of the product at a given tensile strength. While the Durability Index may vary, tissue products prepared according to the present disclosure generally have a Durability Index value of about 28 or greater such as from about 28 to about 32.

As used herein, the term "geometric mean slope" (GM Slope) generally refers to the square root of the product of machine direction slope and cross-machine direction slope. GM Slop generally is expressed in units of kilograms (kg).

As used herein, the term "geometric mean tensile" (GMT) refers to the square root of the product of the machine direction tensile strength and the cross-machine direction tensile strength of the web. While the GMT may vary, tissue products prepared according to the present disclosure generally have a GMT greater than about 730 g/3", more preferably greater than about 750 g/3" and still more preferably greater than about 800 g/3".

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams g) or kilograms (kg).

As used herein, the term "bulk" refers to the quotient of the sheet caliper (generally having units of μm) divided by the bone dry basis weight (generally having units of gsm). The resulting sheet bulk is expressed in cubic centimeters per gram (cc/g). Tissue products prepared according to the present invention generally have a bulk greater than about 8.0 cc/g such as from about 8.0 to about 12.0 cc/g.

As used herein, the term "Stiffness Index" refers to the quotient of the geometric mean tensile slope, defined as the square root of the product of the MD and CD slopes (typically having units of kg), divided by the geometric mean tensile strength (typically having units of g/3").

$$\text{Stiffness Index} = \frac{\sqrt{MD\ \text{Tensile Slope (kg)} \times CD\ \text{Tensile Slope (kg)}}}{GMT\ (\text{g}/3'')} \times 1{,}000$$

While the Stiffness Index may vary tissue products prepared according to the present disclosure generally have a Stiffness Index less than about 14 such as from about 10 to about 14.

As used herein, the term "TEA Index" refers the geometric mean tensile energy absorption (typically having units of g·cm/cm$^2$) at a given geometric mean tensile strength (typically having units of g/3") as defined by the equation:

$$TEA\ \text{Index} = \frac{GM\ TEA\ (\text{g}\cdot\text{cm/cm2})}{GMT(\text{g}/3'')} \times 1{,}000$$

While the TEA Index may vary tissue products prepared according to the present disclosure generally have a TEA Index greater than about 7.0 such as from about 7.0 to about 8.0.

As used herein, the term "Tear Index" refers to the GM Tear Strength (typically expressed in grams) at a relative geometric mean tensile strength (typically having units of g/3") as defined by the equation:

$$\text{Tear Index} = \frac{GM\ \text{Tear (g)}}{GMT\ (\text{g/3}'')} \times 1{,}000$$

While the Tear Index may vary tissue products prepared according to the present disclosure generally have a Tear Index greater than about 9.0 such as from about 9.0 to about 12.0.

As used herein, the term "TS7" refers to the output of the EMTEC Tissue Softness Analyzer (commercially available from Emtec Electronic GmbH, Leipzig, Germany) as described in the Test Methods section. TS7 has units of dB V2 rms; however, TS7 may be referred to herein without reference to units.

As used herein, a "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

As used herein the term "substantially free" refers to a layer of a tissue that has not been formed with the addition of cross-linked fiber. Nonetheless, a layer that is substantially free of cross-linked fiber may include de minimus amounts of cross-linked fiber that arise from the inclusion of cross-linked fibers in adjacent layers and do not substantially affect the softness or other physical characteristics of the tissue web.

DETAILED DESCRIPTION

Generally the present invention provides creped tissue webs and products having improved bulk without increases in stiffness, and deterioration in strength or softness. As such the creped tissue webs and products of the present invention generally have bulks greater than about 8.0 cc/g, such as from about 8.0 to about 12.0 cc/g and more preferably from about 9.0 to about 10.5 cc/g. At these bulks, the tissue products generally have a GMT greater than about 730 g/3", such as from about 730 to about 1,500 g/3" and more preferably from about 750 to about 1,200 g/3", a Stiffness Index less than about 12.0 and relatively modest amounts of Slough, such as less than about 10.0 mg. These properties combine to provide a tissue product that is strong enough to withstand use, yet soft enough and with sufficiently low Slough to satisfy the user.

The foregoing tissue properties are generally achieved by using cross-linked fibers in the manufacture of the tissue product and webs. Accordingly, in certain embodiments, tissue products of the present invention comprise cross-linked fibers and more preferably cross-linked hardwood kraft fibers and still more preferably cross-linked eucalyptus hardwood kraft (EHWK) fibers. The cross-linked fiber, formed in accordance with the present invention, may be useful in the production of tissue products having improved bulk and softness. More importantly, the cross-linked fiber is adaptable to current tissue making processes and may be incorporated into a tissue product to improve bulk and softness without an unsatisfactory reduction in tensile.

Surprisingly, the increase in bulk may be achieved with resorting to embossing the tissue product. Embossing is well known in the art and is often employed to improve the bulk of tissue products. Here, however, tissue sheet bulk is generally improved without resorting to embossment or other treatments which cause the sheet to have a pattern of densified areas. Rather, the instant tissue products generally achieve improved bulk by incorporating cross-linked fibers.

Compared to commercially available tissue products, tissue products prepared according to the present disclosure are generally softer (measured as TS7—a lower value indicates a softer product), less stiff (measured as Stiffness Index) and have higher bulk, as illustrated in Table 1 below.

TABLE 1

| Sample | Bulk (cc/g) | GMT (g/3") | Stiffness Index | Slough (mg) | TS7 |
|---|---|---|---|---|---|
| Kleenex ® Mainline Facial Tissue | 6.7 | 815 | 11.3 | 4.2 | 9.8 |
| Puffs Plus ® Facial Tissue | 7.6 | 873 | 14 | 4.1 | 9.8 |
| Puffs Ultra Strong and Soft ® Facial Tissue | 7.2 | 946 | 13.1 | 9.7 | 8.8 |
| Scotties ® Facial Tissue | 5.8 | 1036 | 32 | 5.1 | 12 |
| Publix ® Facial Tissue | 6.4 | 766 | 13.3 | 1.1 | 12.9 |
| Inventive Tissue Product | 8.6 | 754 | 12.2 | 9.2 | 8.8 |

Accordingly, in certain embodiments, tissue products produced according to the present disclosure have a GMT greater than about 730 g/3", such as from about 730 to about 1,500 g/3" and more preferably from about 730 to about 1,200 g/3", and still more preferably from about 750 to about 1,000 g/3". At these strengths, the tissue products generally have GM Slopes less than about 12 kg, such as from about 9 to about 12 kg, and in particularly preferred embodiments from about 9.5 to about 11 kg. At the foregoing tensile and slopes tissue products have relatively low Stiffness Index, such as less than about 15.0, for example from about 10.0 to about 15.0 and in particularly preferred embodiments from about 10.0 to about 13.0.

In addition to having sufficient strength to withstand use and relatively low stiffness, the tissue webs and products of the present disclosure also have good bulk characteristics. For instance, tissue products prepared according to the present invention may have a bulk greater than about 8.0 cc/g, such as from about 8.0 to about 12.0 cc/g and more preferably from about 9.0 to 11.0 cc/g. In other embodiments the present invention provides a non-embossed, creped, wet pressed tissue having a bulk from about 8.0 to about 12.0 cc/g, a GMT from about 730 to about 1,200 g/3" and a Stiffness Index less than about 12, such as from about 10 to about 12.

Further, in certain embodiments, the tissue products of the present invention are soft, having a TS7 value less than about 10.0, such as from about 5.0 to about 10.0 and more preferably from about 5.5 to about 9.0, but are not overly linty, such as having a Slough less than about 10.0 mg, such as from about 7.0 to about 10.0 mg.

Unexpectedly Slough, bulk, strength and softness are best balanced when the cross-linked fibers are selectively incorporated into one or more outer layers of the tissue web and when the cross-linked fibers comprised cross-linked hardwood fibers. Webs produced in this manner not only display a surprising increase in bulk, but also produce webs having reduced stiffness without a significant deterioration in strength. Accordingly, in one embodiment the present disclosure provides a multilayered tissue web comprising a felt layer and a dryer layer, wherein cross-linked fibers are selectively disposed in the felt layer. In still other embodiments the present disclosure provides a multilayered tissue web comprising a felt layer and a dryer layer, wherein cross-linked fibers are selectively disposed in the dryer layer. In still another embodiment the tissue web comprises a felt, a middle and a dryer layer, wherein the cross-linked fibers are selectively incorporated into the felt and dryer layers. As such the cross-linked fibers may be disposed adjacent to the middle layer, which comprises uncross-linked fiber and which is substantially free from cross-linked fiber. In another embodiment the web comprises three layers (felt, middle and dryer) where cross-linked fibers are disposed in the felt layer and the middle and dryer layers are substantially free from cross-linked fibers.

The effect of selectively incorporating cross-linked fibers in the outer layers is illustrated in Table 2 below. Table 2 compares the change in various tissue product properties relative to comparable tissue products comprising conventional NSWK. All tissues shown in Table 2 comprise two three-layered webs, the tissues having a target basis weight of about 31 gsm and conventional NSWK content of about 30 weight percent. Further, each product was prepared with similar refining and strength additives to achieve a target GMT of about 900 g/3".

TABLE 2

| Sample | Cross-linked fiber (wt %) | Bulk (cc/g) | Delta Bulk (%) | GMT (g/3") | Delta GMT (%) | Stiffness Index | Delta Stiffness Index (%) |
|---|---|---|---|---|---|---|---|
| Control | — | 7.03 | — | 931 | — | 15.06 | — |
| Outer Layers | 30% | 8.23 | 17 | 928 | −0.3 | 12.63 | −16 |
| Blended | 30% | 8.05 | 15 | 805 | −13.5 | 12.62 | −16 |

While the foregoing structures represent certain preferred embodiments it should be understood that the tissue product can include any number of plies or layers and can be made from various types of conventional unreacted cellulosic fibers and cross-linked fibers. For example, the tissue webs may be incorporated into tissue products that may be either single or multi-ply, where one or more of the plies may be formed by a multi-layered tissue web having cross-linked fibers selectively incorporated in one of its layers.

Regardless of the exact construction of the tissue product, the tissue product comprises uncross-linked fibers, also referred to herein as conventional fibers. Conventional cellulosic fibers may comprise wood pulp fibers formed by a variety of pulping processes, such as kraft pulp, sulfite pulp, thermomechanical pulp, etc. Further, the wood fibers may have any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood fibers include hardwood fibers, such as, but not limited to, eucalyptus, maple, birch, aspen, and the like, which can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste.

In addition to conventional fibers the tissue products and webs of the present invention comprise cross-linked fibers. The cross-linked fibers may be blended with conventional fibers to form homogenous tissue webs or they may be selectively incorporated into one or more layers of a multi-layered tissue webs as discussed above. In one particular embodiment, the cross-linked fibers comprise hardwood pulp fibers reacted with a cross-linking agent selected from the group consisting of 1,3-dimethyl-4,5-dihydroxy-2-imidazolidinone (DMDHU), 1,3-dihydroxymethyl-4,5-dihydroxy-2-imidazolidinone (DMDHEU), bis[N-hydroxymethyl]urea (DMU), 4,5-dihydroxy-2-imidazolidinone (DHEU), 1,3-dihydroxymethyl-2-imidazolidinone (DMEU) and 4,5-dihydroxy-1,3-dimethyl-2-imidazolidinone (DMeDHEU). The cross-linked hardwood pulp fibers are incorporated into a multi-layered web having a first layer comprising a blend of cross-linked and uncross-linked hardwood kraft fibers and a second layer comprising softwood fiber. In such embodiments the cross-linked fiber may be added to the first layer, such that the first layer comprises greater than about 2 percent, by weight of the tissue product, cross-linked fiber, such as from about 2 to about 40 percent and more preferably from about 5 to about 30 percent.

The chemical composition of the cross-linked fiber of the invention depends, in part, on the extent of processing of the cellulosic fiber from which the cross-linked fiber is derived. In general, the cross-linked fiber of the invention is derived from a fiber that has been subjected to a pulping process (i.e., a pulp fiber). Pulp fibers are produced by pulping processes that seek to separate cellulose from lignin and hemicellulose leaving the cellulose in fiber form. The amount of lignin and hemicellulose remaining in a pulp fiber after pulping will depend on the nature and extent of the pulping process. Thus, in certain embodiments the invention provides a cross-linked fiber comprising lignin, cellulose, hemicellulose and a covalently bonded cross-linking agent.

A wide variety of cross-linking agents are known in the art and may be suitable for use in the present invention. For example, U.S. Pat. No. 5,399,240, the contents of which are incorporated herein in a manner consistent with the present invention, discloses cross-linking agents for cross-linking cellulosic fibers, which may be useful in the present invention.

In certain embodiments the cross-linking agent may comprise a urea-based cross-linking agent. Suitable urea-based cross-linking agents include substituted ureas such as methylolated ureas, methylolated cyclic ureas, methylolated lower alkyl cyclic ureas, methylolated dihydroxy cyclic ureas, dihydroxy cyclic ureas, and lower alkyl substituted cyclic ureas. Specific urea-based cross-linking agents include dimethyldihydroxy urea (DMDHU, 1,3-dimethyl-4,5-dihydroxy-2-imidazolidinone), dimethylol dihydroxy ethylene urea (DMDHEU, 1,3-dihydroxymethyl-4,5-dihydroxy-2-imidazolidinone), dimethylol urea (DMU, bis[N-hydroxymethyl]urea), dihydroxyethylene urea (DHEU, 4,5-dihydroxy-2-imidazolidinone), dimethylolethylene urea (DMEU, 1,3-dihydroxymethyl-2-imidazolidinone), and dimethyldihydroxyethylene urea (DMeDHEU or DDI, 4,5-dihydroxy-1,3-dimethyl-2-imidazolidinone). A particularly preferred urea is dimethyldihydroxy urea (DMDHU, 1,3-dimethyl-4,5-dihydroxy-2-imidazolidinone.

In other embodiments the cross-linking agent may comprise a glyoxal adduct of urea such as that disclosed in U.S. Pat. No. 4,968,774, the contents of which are incorporated herein in a manner consistent with the present disclosure.

In still other embodiments the cross-linking agent may comprise a dialdehyde. Suitable dialdehydes include, for example, $C_2$-$C_8$ dialdehydes, $C_2$-$C_8$ dialdehyde acid analogs having at least one aldehyde group, and oligomers of these aldehyde and dialdehyde acid analogs, such as those described in U.S. Pat. No. 8,475,631, the contents of which are incorporated herein in a manner consistent with the present disclosure. A particularly preferred dialdehyde glyoxal is ethanedial.

In still other embodiments the cross-linking agent may comprise polymeric polycarboxylic acids such as those disclosed in U.S. Pat. Nos. 5,221,285 and 5,998,511, the contents of which are incorporated herein in a manner consistent with the present disclosure. Suitable polymeric polycarboxylic acid cross-linking agents include, for example, polyacrylic acid polymers, polymaleic acid polymers, copolymers of acrylic acid, copolymers of maleic acid, and mixtures thereof. Specific suitable polycarboxylic acid cross-linking agents include citric acid, tartaric acid, malic acid, succinic acid, glutaric acid, citraconic acid, itaconic acid, tartrate monosuccinic acid, maleic acid, polyacrylic acid, polymethacrylic acid, polymaleic acid, polymethylvinylether-co-maleate copolymer, polymethylvinylether-co-itaconate copolymer, copolymers of acrylic acid, and copolymers of maleic acid.

Suitable methods of preparing cross-linked fibers include those disclosed in U.S. Pat. No. 5,399,240, the contents of which are incorporated by reference in a manner consistent with the present disclosure. The cross-linking agent is applied to the cellulosic fibers in an amount sufficient to effect intrafiber cross-linking. The amount applied to the cellulosic fibers can be from about 1 to about 10 percent by weight based on the total weight of fibers. In one embodiment, the cross-linking agent is applied in an amount from about 4 to about 6 percent by weight based on the total weight of fibers.

In one embodiment cross-linked fibers may be prepared by first forming a mat of fiber, such as EHWK, and saturating the mat with an aqueous solution comprising a cross-linking agent selected from the group consisting of DMDHU, DMDHEU, DMU, DHEU, DMEU, and DMeDHEU. In certain embodiments the aqueous solution may further comprise a catalyst for increasing the rate of bond formation between the cross-linking agent and the cellulose fibers. Preferred catalysts include alkali metal salts of phosphorous containing acids such as alkali metal hypophosphites, alkali metal phosphites, alkali metal polyphosphonates, alkali metal phosphates, and alkali metal sulfonates. The pulp mat, after saturation with the solution, may be pressed to partially dry the mat and then further dried by air drying to produce a treated sheet. The treated sheet is then defibered in a hammermill to form a fluff consisting essentially of individual fibers, which are then heated to between 300° F. and 340° F. to cure the fiber and effect cross-linking.

Cross-linked cellulosic fibers are generally incorporated into the tissue products and webs of the present invention such that the web or product comprises from about 5 to about 75 percent, more preferably from about 20 to about 60 percent, still more preferably from about 30 to about 50 percent cross-linked cellulosic fibers. As mentioned above, the cross-linked cellulosic fibers may be blended with conventional uncross-linked fibers to form a homogenous structure, or more incorporated into one or more layers of a layered structured. In particularly preferred embodiments the cross-linked cellulosic fibers are selectively incorporated into a single layer of a three layered tissue web and more preferably the felt layer of a three layer tissue web. Where the cross-linked cellulosic fibers comprise cross-linked-EWHK it may be preferred to form a tissue web comprising a first and second layer, where the first layer comprises cross-linked-EWHK and the second layer comprises uncross-linked Northern softwood kraft fiber (NSWK). In those embodiments where the tissue comprises NSWK, the NSWK is preferably conventional NSWK. In further embodiments it may be preferred that the second layer be substantially free from cross-linked-EHWK and that the web comprise from about 5 to about 75 percent, by weight of the web, cross-linked-EWHK and still more preferably from about 30 to about 50 weight percent.

Webs that include the cross-linked fibers can be prepared in any one of a variety of methods known in the web-forming art. In a particularly preferred embodiment cross-linked fibers are incorporated into tissue webs formed by creping the web from a drying cylinder and more preferably involve pressing the web onto the drying cylinder via felt. In other embodiments the papermaking process of the present disclosure can utilize adhesive creping, wet creping, double creping, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

As noted previously, the tissue webs and products of the present invention may generally improve sheet bulk without reductions in strength without embossing the web or product. Accordingly, in one particularly preferred embodiment the tissue webs and products of the present invention are not subject to embossing or the like during manufacture. As such, in a preferred embodiment, the tissue products of the present invention generally comprise substantially smooth tissue plies that do not have patterns or the like embossed on their surface.

Fibrous tissue webs can generally be formed according to a variety of papermaking processes known in the art. For example, wet-pressed tissue webs may be prepared using methods known in the art and commonly referred to as couch forming, wherein two wet web layers are independently formed and thereafter combined into a unitary web. To form the first web layer, fibers are prepared in a manner well known in the papermaking arts and delivered to the first stock chest, in which the fiber is kept in an aqueous suspension. A stock pump supplies the required amount of suspension to the suction side of the fan pump. Additional dilution water also is mixed with the fiber suspension.

To form the second web layer, fibers are prepared in a manner well known in the papermaking arts and delivered to the second stock chest, in which the fiber is kept in an aqueous suspension. A stock pump supplies the required amount of suspension to the suction side of the fan pump. Additional dilution water is also mixed with the fiber suspension. The entire mixture is then pressurized and delivered to a headbox. The aqueous suspension leaves the headbox and is deposited onto an endless papermaking fabric over the suction box. The suction box is under vacuum which draws water out of the suspension, thus forming the second wet web. In this example, the stock issuing from the headbox is referred to as the "dryer side" layer as that layer will be in eventual contact with the dryer surface. In some embodiments, it may be desired for a layer containing the treated cellulosic fibers and pulp fiber blend to be formed as the "dryer side" layer.

After initial formation of the first and second wet web layers, the two web layers are brought together in contacting relationship (couched) while at a consistency of from about 10 to about 30 percent. Whatever consistency is selected, it is typically desired that the consistencies of the two wet webs be substantially the same. Couching is achieved by bringing the first wet web layer into contact with the second wet web layer at roll.

After the consolidated web has been transferred to the felt at the vacuum box, dewatering, drying and creping of the consolidated web is achieved in the conventional manner. More specifically, the couched web is further dewatered and transferred to a dryer (e.g., Yankee dryer) using a pressure roll, which serves to express water from the web, which is absorbed by the felt, and causes the web to adhere to the surface of the dryer.

The wet web is applied to the surface of the dryer by a press roll with an application force of, in one embodiment, about 200 pounds per square inch (psi). Following the pressing or dewatering step, the consistency of the web is typically at or above about 30 percent, Sufficient Yankee dryer steam power and hood drying capability are applied to this web to reach a final consistency of about 95 percent or greater, and particularly 97 percent or greater. The sheet or web temperature immediately preceding the creping blade, as measured, for example, by an infrared temperature sensor, is typically about 200° F. or higher. Besides using a Yankee dryer, it should also be understood that other drying methods, such as microwave or infrared heating methods, may be used in the present invention, either alone or in conjunction with a Yankee dryer.

At the Yankee dryer, the creping chemicals are continuously applied on top of the existing adhesive in the form of an aqueous solution. The solution is applied by any convenient means, such as using a spray boom that evenly sprays the surface of the dryer with the creping adhesive solution. The point of application on the surface of the dryer is immediately following the creping doctor blade, permitting sufficient time for the spreading and drying of the film of fresh adhesive.

The creping composition may comprise a non-fibrous olefin polymer, as disclosed in U.S. Pat. No. 7,883,604, the contents of which are hereby incorporated by reference in a manner consistent with the present disclosure, which may be applied to the surface of the Yankee dryer as a water insoluble dispersion that modifies the surface of the tissue web with a thin, discontinuous polyolefin film. In particularly preferred embodiments the creping composition may comprise a film-forming composition and an olefin polymer comprising an interpolymer of ethylene and at least one comonomer comprising an alkene, such as 1-octene. The creping composition may also contain a dispersing agent, such as a carboxylic acid. Examples of particular dispersing agents, for instance, include fatty acids, such as oleic acid or stearic acid.

In one particular embodiment, the creping composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

The olefin polymer composition may exhibit a crystallinity of less than about 50 percent, such as less than about 20 percent. The olefin polymer may also have a melt index of less than about 1000 g/10 min, such as less than about 700 g/10 min. The olefin polymer may also have a relatively small particle size, such as from about 0.1 to about 5 microns when contained in an aqueous dispersion.

In an alternative embodiment, the creping composition may contain an ethylene-acrylic acid copolymer. The ethylene-acrylic acid copolymer may be present in the creping composition in combination with a dispersing agent.

In still other embodiments the creping composition may comprise one or more water soluble cationic polyamide-epihalohydrin, which is the reaction product of an epihalohydrin and a polyamide containing secondary amine groups or tertiary amine groups. Suitable water soluble cationic polyamide-epihalohydrins are commercially available under the trade names including Kymene™, Crepetrol™ and Rezosol™ (Ashland Water Technologies, Wilmington, Del.). In other embodiments the creping composition may comprise a water soluble cationic polyamide-epihalohydrin and an adhesive component, such as a polyvinyl alcohol or a polyethyleneimine.

Test Methods

Sheet Bulk

Sheet Bulk is calculated as the quotient of the dry sheet caliper expressed in microns, divided by the bone dry basis weight, expressed in grams per square meter (gsm). The resulting Sheet Bulk is expressed in cubic centimeters per gram. More specifically, the Sheet Bulk is the representative caliper of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board." The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm). The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm·cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006 inches) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the proscribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single ply basesheet. This is done by multiplying the single ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Burst Strength

Burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, Minn.) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings has an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturer's instructions.

Samples are conditioned under TAPPI conditions and cut into 127×127 mm±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Prior to testing, the height of the probe is adjusted as necessary by inserting the burst fixture into the bottom of the tensile tester and lowering the probe until it was positioned approximately 12.7 mm above the alignment plate. The length of the probe is then adjusted until it rests in the recessed area of the alignment plate when lowered.

It is recommended to use a load cell in which the majority of the peak load results fall between 10 and 90 percent of the capacity of the load cell. To determine the most appropriate load cell for testing, samples are initially tested to determine peak load. If peak load is <450 gf a 10 Newton load cell is used, if peak load is >450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (gf) and energy to peak (g-cm) are recorded and the process repeated for all remaining specimens. A minimum of five specimens are tested per sample and the peak load average of five tests is reported as the Dry Burst Strength.

Slough

Slough, also referred to as "pilling," is a tendency of a tissue sheet to shed fibers or clumps of fibers when rubbed or otherwise handled. The Slough test provides a quantitative measure of the abrasion resistance of a tissue sample. More specifically, the test measures the resistance of a material to an abrasive action when the material is subjected to a horizontally reciprocating surface abrader. The equipment and method used is similar to that described in U.S. Pat. No. 6,808,595, the disclosure of which is incorporated herein in a manner consistent with the present disclosure.

Prior to testing, all tissue sheet samples are conditioned at 23±1° C. and 50±2% relative humidity for a minimum of 4 hours. Using a JDC-3 or equivalent precision cutter, available from Thwing-Albert Instrument Company, Philadelphia, Pa., the tissue sheet sample specimens are cut into 3±0.05" wide×7" long strips. For tissue sheet samples, the MD direction corresponds to the longer dimension. Each tissue sheet sample is weighed to the nearest 0.1 mg. One end of the tissue sheet sample is clamped to the fixed clamp, the sample is then loosely draped over the abrading spindle or mandrel and clamped into the sliding clamp. The entire width of the tissue sheet sample should be in contact with the abrading spindle. The sliding clamp is then allowed to fall providing constant tension across the abrading spindle.

The abrading spindle is then moved back and forth at an approximate degree angle from the centered vertical centerline in a reciprocal horizontal motion against the tissue sheet sample for 20 cycles (each cycle is a back and forth stroke), at a speed of 170 cycles per minute, removing loose fibers from the surface of the tissue sheet sample. Additionally the spindle rotates counter clockwise (when looking at the front of the instrument) at an approximate speed of 5 RPMs. The tissue sheet sample is then removed from the jaws and any loose fibers on the surface of the tissue sheet sample are removed by gently shaking the tissue sheet sample. The tissue sheet sample is then weighed to the nearest 0.1 mg and the weight loss calculated. Ten tissue sheet specimens per sample are tested and the average weight loss value in milligrams (mg) is recorded, which is the Slough value for the side of the tissue sheet being tested.

Tissue Softness

Sample softness was analyzed using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. The frequency analysis in the range of approximately 200 Hz to 1000 Hz represents the surface smoothness or texture of the test piece. A high amplitude peak correlates to a rougher surface. A further peak in the frequency range between 6 kHZ and 7 kHZ represents the softness of the test piece. The peak in the frequency range between 6 kHZ and 7 kHZ is herein referred to as the TS7 Softness Value and is expressed as dB V2 rms. The lower the amplitude of the peak occurring between 6 kHZ and 7 kHZ, the softer the test piece.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the TS7 Softness Values measurements are started via the PC. The PC records, processes and stores all of the data according to standard TSA protocol. The reported TS7 Softness Value is the average of 5 replicates, each one with a new sample.

Examples

Cross-linked fibers were prepared by first dispersing eucalyptus hardwood kraft (EHWK) in a pulper for approximately 30 minutes at a consistency of about 10 percent. The pulp was then pumped to a machine chest and diluted to a consistency of about 2 percent and then pumped to a headbox and further diluted to a consistency of about 1 percent. From the headbox, the fibers were deposited onto a felt using a Fourdrinier former. The fiber web was pressed and dried to form a fiber web having a consistency of about 90 percent and a bone dry basis weight from about 500 to 700 gsm. The fiber web was treated with a 25 percent solids solution of DMDHEU (commercially available from Omnova Solutions, Inc. under the trade name Permafresh® CSI-2) using a flooded-nip horizontal size press. In certain instances 0.01 percent by weight CMC (commercially available from CP Kelco under the trade name Finnfix®300 CMC) was added to the DMDHEU solution to adjust solution viscosity. The sheet was saturated in the flooded nip and squeezed to evenly distribute the cross-linker solution. After the size press, the sheet was dried (approximately 220° F.) to around 92 percent consistency and rolled on a reel. The treated pulp was mechanically separated in a hammermill using a screen with 3 mm holes. Separated fibers were pneumatically conveyed to an air-forming head where they were laid onto a carrier tissue at a basis weight of around 200 to 400 gsm. The airlaid fiber mat was continuously conveyed through a through-air dryer at about 170° F. The fiber mat was conveyed at a rate of around 1.8 to 2.5 m/min, for a total residence time from about 5 to about 7 minutes. The resulting cross-linked eucalyptus hardwood kraft fibers (XL-EWHK) were collected and used to prepare tissue webs as described below.

The XL-EWHK was used to produce tissue products utilizing a conventional wet pressed tissue-making process on a pilot scale tissue machine. Several different tissue products were formed to assess the effect of XL-EWHK on tissue properties. The tissue products comprised both blended and layered sheet structures. The furnish composition and distribution of the various tissue products is summarized in Table 3, below.

Northern softwood kraft (NSWK) furnish was prepared by dispersing NSWK pulp in a pulper for 30 minutes at about 2 percent consistency at about 100° F. The NSWK pulp was refined at 1.5 hp-days/metric ton as set forth in Table 3, below. The NSWK pulp was then transferred to a dump chest and subsequently diluted with water to approximately 0.2 percent consistency. Softwood fibers were then pumped to a machine chest. In certain instances wet strength resin (Kymene™ 920A, Ashland, Inc., Covington, Ky.) was added to the NSWK pulp.

Eucalyptus hardwood kraft (EHWK) furnish was prepared by dispersing EWHK pulp in a pulper for 30 minutes at about 2 percent consistency at about 100° F. The EHWK pulp was then transferred to a dump chest and diluted to about 0.2 percent consistency. The EHWK pulp was then pumped to a machine chest. In certain instances wet strength resin (Kymene™ 920A, Ashland, Inc., Covington, Ky.) was added to the EHWK pulp.

Cross-linked EHWK (XL-EWHK), prepared as described above, was dispersed in a pulper for 30 minutes at about 2 percent consistency at about 100° F. The XL-EWHK was then transferred to a dump chest and diluted to about 0.2 percent consistency. The XL-EWHK was then pumped to a machine chest. In certain instances wet strength resin (Kymene™ 920A, Ashland, Inc., Covington, Ky.) was added to the XL-EWHK pulp.

TABLE 3

| Sample | Web Structure | Creping Composition | Refining (min) | Starch (kg/MT) | XL-EHWK (wt %) | Felt Layer (wt %) | Center Layer (wt %) | Dryer Layer (wt %) |
|---|---|---|---|---|---|---|---|---|
| 1 | Layered | HYPOD 8510 | 3 | 5 | — | EHWK (35%) | NSWK (30%) | EHWK (35%) |
| 2 | Layered | HYPOD 8510 | 9 | 5 | 30% | XL-EHWK (15%) EHWK (20%) | NSWK (30%) | XL-EHWK (15%) EHWK (20%) |
| 3 | Blended | HYPOD 8510 | 11 | 0 | 30% | — | — | — |
| 4 | Layered | HYPOD 8510 | 6 | 3 | — | EHWK (35%) | NHWK (30%) | EHWK (35%) |
| 5 | Layered | HYPOD 8510 | 11 | 5 | 30% | XL-EHWK (15%) EHWK (20%) | NSWK (30%) | XL-EHWK (15%) EHWK (20%) |
| 6 | Layered | CrepetrolA9915 | 10 | 5 | 32% | XL-EHWK (16%) EHWK (19%) | NSWK (30%) | XL-EHWK (16%) EHWK (19%) |
| 7 | Layered | HYPOD 8510 | 7 | 1 | 60% | XL-EHWK (30%) | NSWK (40%) | XL-EHWK (30%) |

The pulp fibers from the machine chests were pumped to the headbox at a consistency of about 0.1 percent. To form a three-layered tissue web, pulp fibers from each machine chest were sent through separate manifolds in the headbox prior to being deposited onto a felt using an inclined Fourdrinier former.

The consistency of the wet sheet after the pressure roll nip (post-pressure roll consistency or PPRC) was approximately 44 percent. A spray boom situated underneath the Yankee dryer sprayed a creping composition at a pressure of 80 psi. In certain instances the creping composition comprised non-fibrous olefin dispersion, sold under the trade name HYPOD 8510 (commercially available from the Dow Chemical Co.). The HYPOD 8510 was delivered at a total addition of about 150 mg/m$^2$ spray coverage on the Yankee Dryer. In other instances, as indicated in Table 3 above, the creping composition comprised Crepetrol® A9915 (commercially available from Ashland, Inc., Covington, Ky.), which was delivered at a total addition of about 30 mg/m$^2$ spray.

The sheet was dried to about 98 to 99 percent consistency as it traveled on the Yankee dryer and to the creping blade. The creping blade subsequently scraped the tissue sheet and a portion of the creping composition off the Yankee dryer. The creped tissue basesheet was then wound onto a core traveling at about 50 to about 100 fpm into soft rolls for converting.

To produce the 2-ply facial tissue products, two soft rolls of the creped tissue were then rewound, calendered, and plied together so that both creped sides were on the outside of the 2-ply structure. Mechanical crimping on the edges of the structure held the plies together. The plied sheet was then slit on the edges to a standard width of approximately 8.5 inches and folded, and cut to facial tissue length. Tissue samples were conditioned and tested. The results of the testing are summarized in Tables 4 and 5, below.

TABLE 4

| Sample | BW (gsm) | Caliper (μm) | Bulk (cc/g) | GMT (g/3") | GM Slope (kg/3") | GM TEA | GM Tear | Burst (gf) |
|---|---|---|---|---|---|---|---|---|
| 1 | 31.1 | 217 | 7.03 | 931 | 14.0 | 6.98 | 9.15 | 466 |
| 2 | 30.5 | 251 | 8.23 | 928 | 11.7 | 7.42 | 10.8 | 532 |

TABLE 4-continued

| Sample | BW (gsm) | Caliper (μm) | Bulk (cc/g) | GMT (g/3") | GM Slope (kg/3") | GM TEA | GM Tear | Burst (gf) |
|---|---|---|---|---|---|---|---|---|
| 3 | 30.8 | 241 | 8.05 | 805 | 10.2 | 6.10 | 7.60 | 427 |
| 4 | 26.7 | 188 | 7.26 | 802 | 11.1 | 6.07 | 8.73 | 475 |
| 5 | 26.4 | 220 | 8.58 | 754 | 9.2 | 5.45 | 8.38 | 436 |
| 6 | 32.0 | 292 | 9.1 | 788 | 7.6 | 4.99 | — | — |
| 7 | 30.1 | 311 | 10.3 | 735 | 8.1 | 4.64 | — | — |

TABLE 5

| Sample | Stiffness Index | Durability Index | Slough (mg) | TS7 |
|---|---|---|---|---|
| 1 | 15.06 | 31.1 | 8.6 | 8.71 |
| 2 | 12.63 | 30.5 | 9.8 | 8.61 |
| 3 | 12.62 | 30.8 | 6.7 | 8.05 |
| 4 | 13.89 | 26.7 | 5.4 | 7.26 |
| 5 | 12.18 | 26.4 | 9.2 | 8.83 |

TABLE 5-continued

| Sample | Stiffness Index | Durability Index | Slough (mg) | TS7 |
|---|---|---|---|---|
| 6 | 9.69 | — | — | 7.44 |
| 7 | 10.99 | — | — | 5.64 |

The foregoing is one example of an inventive tissue product prepared according to the present disclosure. In other embodiments the disclosure provides a creped tissue product having a geometric mean tensile (GMT) from about 730 to about 1,500 g/3" and a sheet bulk from about 8.0 to about 12.0 cc/g and a TS7 less than about 10.0.

In another embodiment the disclosure provides a tissue product of the foregoing embodiment having a having a Slough less than about 10.0 mg.

In yet another embodiment the disclosure provides a tissue product of any one of the foregoing embodiments having a TS7 value from about 5.0 to about 10.0 and more preferably from about 5.5 to about 9.0.

In still another embodiment the disclosure provides a tissue product of any one of the foregoing embodiments having a having a Durability Index from about 26.0 to about 32.0.

In yet another embodiment the disclosure provides a tissue product of any one of the foregoing embodiments having a Stiffness Index from about 10.0 to about 13.0.

In another embodiment the disclosure provides a tissue product of any one of the foregoing embodiments wherein the tissue product is not embossed.

In other embodiments the disclosure provides a tissue product of any one of the foregoing embodiments wherein the tissue product has a basis weight from about 10 to about 60 gsm and more preferably from about 20 to about 50 gsm and still more preferably from about 25 to about 40 gsm.

In still other embodiments the disclosure provides a tissue product of any one of the foregoing embodiments wherein the product comprises two multi-layered plies, each ply comprising a first fibrous layer comprising cross-linked cellulosic fibers and wherein the product comprises from about 10 to about 50 percent, by weight of the product, cross-linked cellulosic fibers.

In yet other embodiments the disclosure provides a tissue product comprising from about 30 to about 75 percent, by weight of the product, cross-linked hardwood kraft fibers and more preferably cross-linked EHWK fibers and from about 25 to about 70 percent, by weight of the product, uncross-linked conventional NSWK fibers.

In other embodiments the disclosure provides a tissue product of any one of the foregoing embodiments wherein the tissue product comprises at least two multi-layered webs, each web having a first, a second and a third layer wherein the first and third layers comprise cross-linked hardwood fibers. In certain embodiments the foregoing multi-layered webs comprise a second layer that is substantially free from cross-linked hardwood fibers.

In still other embodiments the disclosure provides a tissue product of any one of the foregoing embodiments wherein the tissue product comprises from about 10 to about 50 percent, by weight of the tissue product, cross-linked hardwood fibers. In certain embodiments the cross-linked hardwood fibers comprise eucalyptus hardwood kraft fibers reacted with a cross-linking reagent selected from the group consisting of 1,3-dimethyl-4,5-dihydroxy-2-imidazolidinone (DMDHU), 1,3-dihydroxymethyl-4,5-dihydroxy-2-imidazolidinone (DMDHEU), bis[N-hydroxymethyl]urea (DMU), 4,5-dihydroxy-2-imidazolidinone (DHEU), 1,3-dihydroxymethyl-2-imidazolidinone (DMEU) and 4,5-dihydroxy-1,3-dimethyl-2-imidazolidinone (DMeDHEU).

In other embodiments the disclosure provides a tissue product of any one of the foregoing embodiments wherein the tissue product comprises at least one conventional wet pressed tissue web.

We claim:

1. A tissue product having a geometric mean tensile (GMT) from 730 to 1,200 g/3", a sheet bulk from 8.0 to 12.0 cc/g and a TS7 value less than 10.0, wherein the product comprises two multi-layered, creped and unembossed plies, each ply comprising a first fibrous layer comprising cross-linked cellulosic fibers and a second fibrous layer that is substantially free from cross-linked cellulosic fibers and wherein the product comprises from 5 to 75 percent, by weight of the product, cross-linked hardwood kraft fibers.

2. The tissue product of claim 1 having a Slough less than 10.0 mg.

3. The tissue product of claim 1 having a TS7 value from 5.0 to 9.0.

4. The tissue product of claim 1 having a Durability Index from 26.0 to 32.0.

5. The tissue product of claim 1 having a Stiffness Index from 10.0 to 13.0.

6. The tissue product of claim 1 wherein the cross-linked cellulosic fibers comprise eucalyptus hardwood kraft fibers reacted with a cross-linking reagent selected from the group consisting of 1,3-dimethyl-4,5-dihydroxy-2-imidazolidinone (DMDHU), 1,3-dihydroxymethyl-4,5-dihydroxy-2-imidazolidinone (DMDHEU), bis[N-hydroxymethyl]urea (DMU), 4,5-dihydroxy-2-imidazolidinone (DHEU), 1,3-dihydroxymethyl-2-imidazolidinone(DMEU) and 4,5-dihydroxy-1,3-dimethyl-2-imidazolidinone (DMeDHEU).

7. The tissue product of claim 1 having a Slough less than 10.0 mg and a Durability Index from 26.0 to 32.0.

8. A non-embossed creped multi-ply tissue product having increased sheet bulk, the product comprising at least two multi-layered plies, each ply comprising a first fibrous layer comprising cross-linked cellulosic fibers and a second fibrous layer that is substantially free from cross-linked cellulosic fibers and wherein the product comprises at least 10 percent, by weight of the product, cross-linked cellulosic fibers, wherein the sheet bulk of the product is at least 20 percent greater and geometric mean tensile strength (GMT) is not 5 percent less than a comparable tissue product substantially free of cross-linked cellulosic fibers.

9. The tissue product of claim 8 having a sheet bulk from 8.0 to 12.0 cc/g.

10. The tissue product of claim 8 wherein the cross-linked fibers comprise hardwood kraft fibers reacted with a cross-linking reagent selected from the group consisting of 1,3-dimethyl-4,5-dihydroxy-2-imidazolidinone (DMDHU), 1,3-dihydroxymethyl-4,5-dihydroxy-2-imidazolidinone (DMDHEU), bis[N-hydroxymethyl]urea (DMU), 4,5-dihydroxy-2-imidazolidinone (DHEU), 1,3-dihydroxymethyl-2-imidazolidinone (DMEU) and 4,5-dihydroxy-1,3-dimethyl-2-imidazolidinone (DMeDHEU).

11. The tissue product of claim 8 wherein the product comprises from 10 to 50 percent, by weight of the product, cross-linked cellulosic fiber.

12. The tissue product of claim 8 having a sheet bulk from 9.0 to 11.0 cc/g, a GMT from 730 to 1,200 g/3" and a Stiffness Index from 10 to 13.

* * * * *